United States Patent [19]

Morse

[11] 4,096,947

[45] Jun. 27, 1978

[54] SYNTHETIC RESINOUS NESTING CUP CONSTRUCTION

[76] Inventor: Milton Morse, 44 Honeck St., Englewood, N.J. 07631

[21] Appl. No.: 761,056

[22] Filed: Jan. 21, 1977

[51] Int. Cl.[2] ..... B65D 1/22; B65D 21/00

[52] U.S. Cl. ..... 206/519; 229/1.5 B; 206/217

[58] Field of Search ..... 206/217, 519, 520; 229/1.5 B

[56] References Cited

U.S. PATENT DOCUMENTS

| | | | |
|---|---|---|---|
| 1,592,395 | 7/1926 | Sulzberger | 206/221 |
| 2,667,422 | 1/1954 | Kauffman | 206/519 |
| 3,186,850 | 6/1965 | Anthony | 206/217 |
| 3,521,788 | 7/1970 | Kandel | 206/519 |
| 3,526,316 | 7/1970 | Kalogris | 206/217 |
| 3,739,939 | 6/1973 | Koenig | 206/520 |

*Primary Examiner*—George E. Lowrance
*Attorney, Agent, or Firm*—Charles E. Temko

[57] ABSTRACT

A synthetic resinous nesting cup construction suitable for manual or mechanical or serial dispensing. The cups, in nested condition, each define a recess capable of retaining a dehydrated commestible above a lower wall thereof, the recess being sealed by the engagement of each cup with another nested therein over a predetermined peripheral area adjacent the upper edge of the cup, whereby a substantially uniform force along the axis of a stack of cups is required for each successive separation. The cups are substantially free of other contact when nested. In alternate forms of the invention, the recess is sealed by a soluble or frangible wafer, permitting the cup to be stacked in upside down condition for manual or mechanical separation from a console of table height.

3 Claims, 5 Drawing Figures

FIG. 1
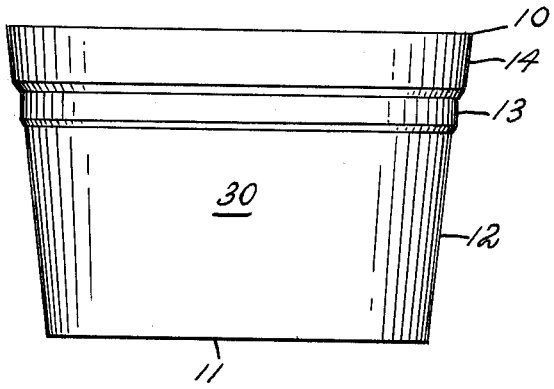
FIG. 3
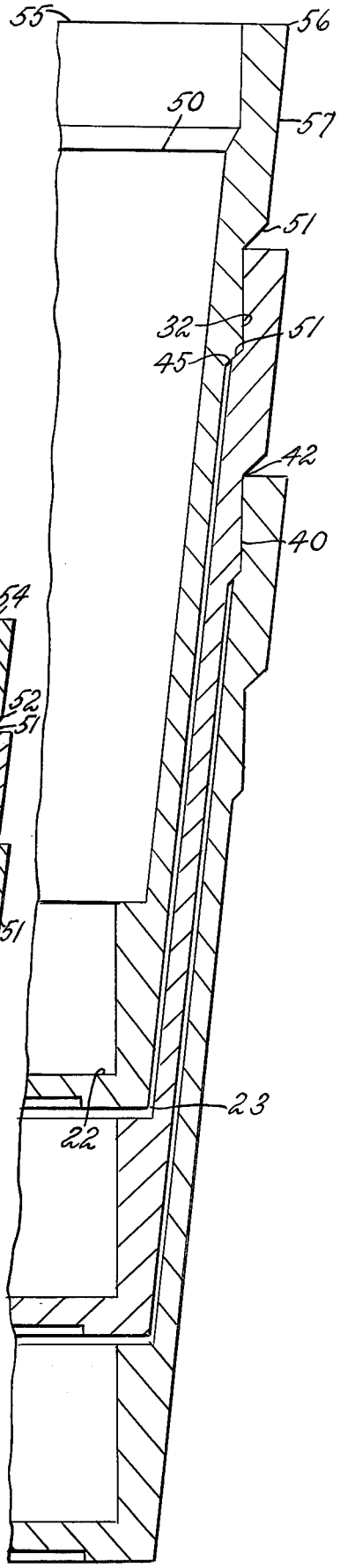
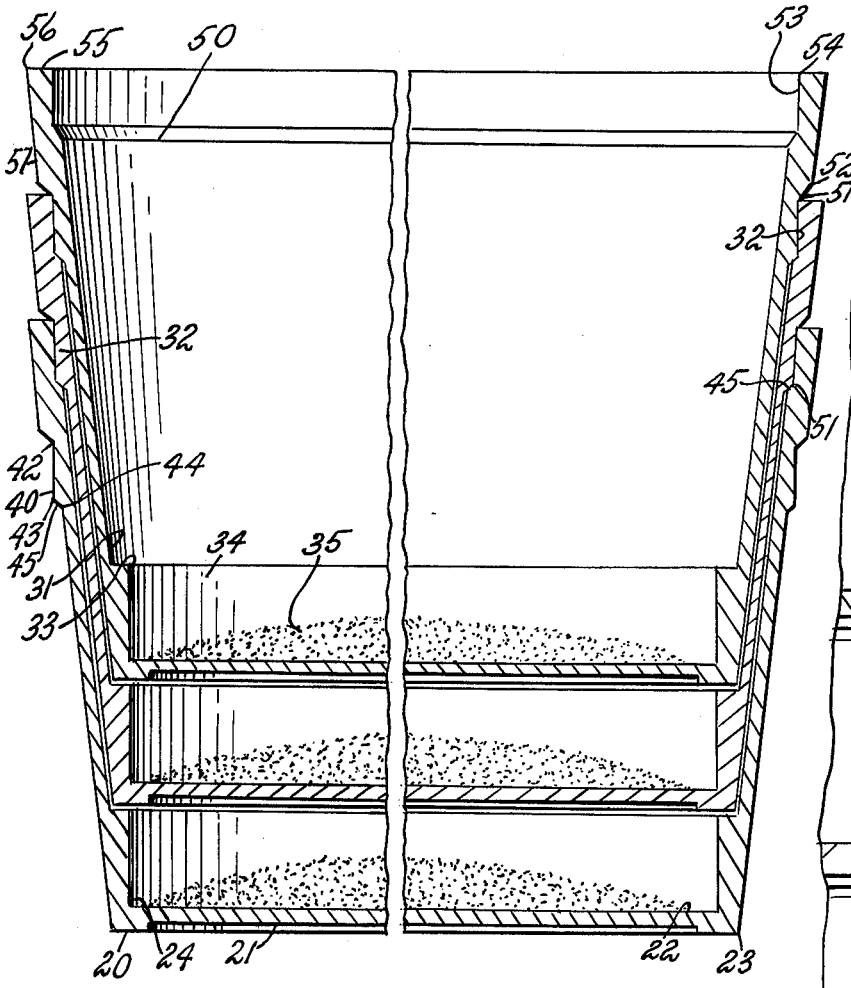
FIG. 2

FIG. 4
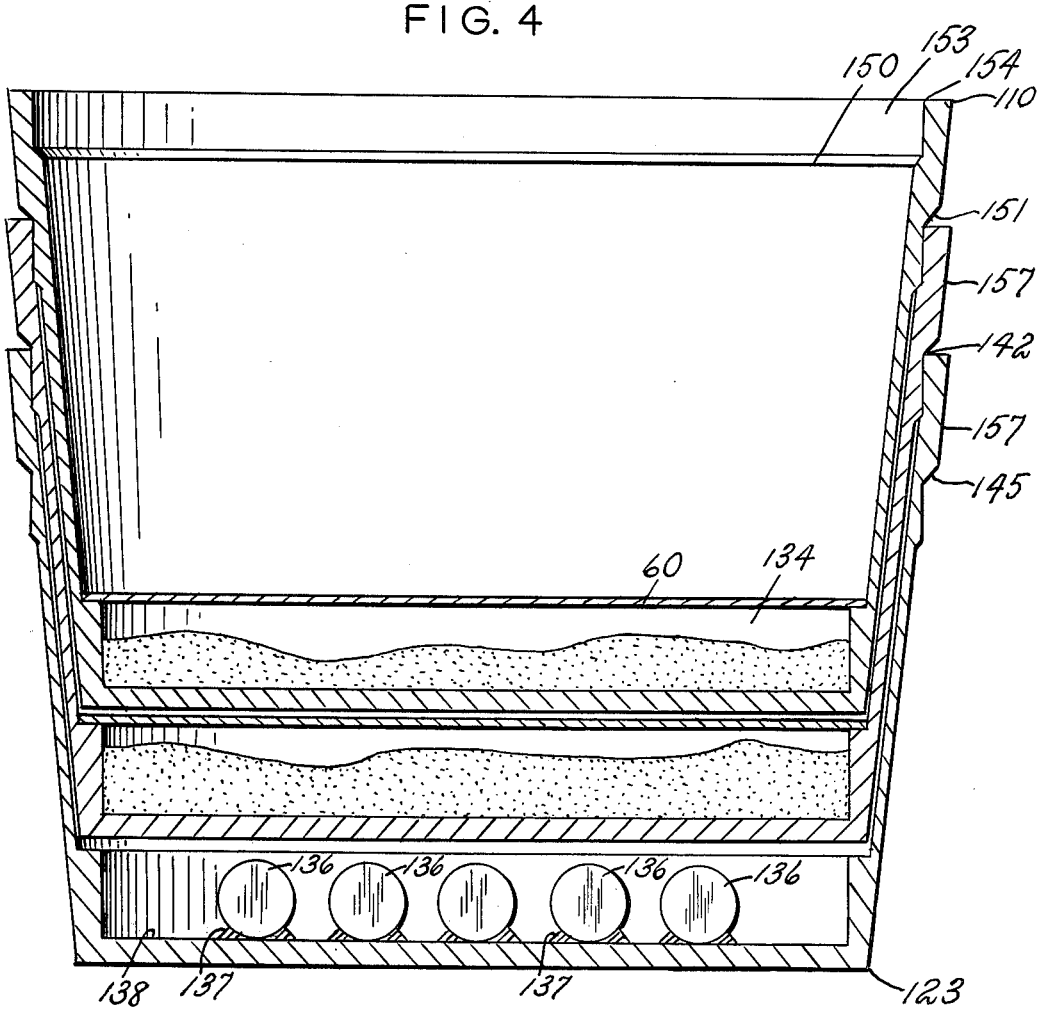
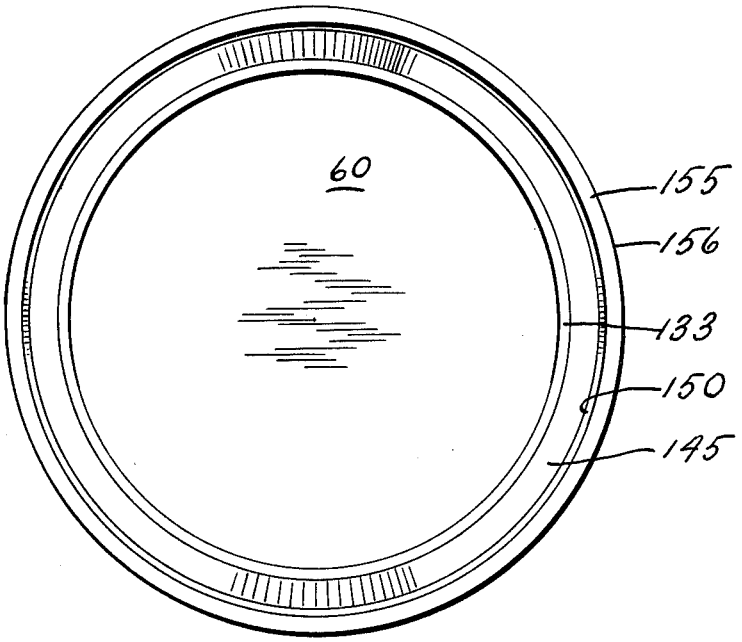
FIG. 5

SYNTHETIC RESINOUS NESTING CUP CONSTRUCTION

BACKGROUND OF THE INVENTION

This invention relates generally to the packaging art, and more particularly to an improved nesting cup construction formed of synthetic resinous resins such as styrofoam, and suitable for serial machine discharge or manual separation.

It is known in the art to provide beverage dispensing devices in which a liquid, usually water, in heated, chilled and/or carbonated condition is mixed with a liquid or solid condensed commestible within the confines of a sequentially discharged cup. When the condensed commestible is in liquid form, the storage of the same within a bottle or similar container is relatively simple. Where the food product is in powdered or particulate form and is stored in a bin, contamination by vermin is common. It is known in the art to store the commestible within the interstice formed between adjacent cup bottoms, but owing to the difficulty of maintaining the commestible in sealed condition, such construction has not been in common use. Either a separate protecting envelope is required which must be subsequently manually opened, or the cups must be sealed together using an adhesive or sealant which makes subsequent separation of the cups difficult.

It is also known to provide a compartment at a lower portion of the interior of a cup having a removable lid or soluble wafer serving to seal the solute contents thereof which may be in either powdered, solid or semi-liquid form.

SUMMARY OF THE INVENTION

Briefly stated, the invention contemplates the provision of a synthetic resinous cup construction of molded styrofoam or the like, in which the sealing of adjacent cups is accomplished over a predetermined cylindrical area adjacent the mouth of the cups, whereby a substantially uniform force is required to separate each cup, thereby affording convenient dispensing operation by mechanical devices. The sealing is accomplished in the absence of adhesives or sealants by providing that the sealing surface of the nesting cups is, in unstressed condition, of diameter slightly smaller than that of the corresponding surface on the nested cup, and is resiliently expanded in a plane perpendicular to the mating surfaces. The cups in nested condition are free of other interconnection, and may be stacked in inverted condition to be used in an upwardly feeding console.

BRIEF DESCRIPTION OF THE DRAWING

In the drawing, to which reference will be made in the specification, similar reference characters have been employed to designate corresponding parts throughout the several views.

FIG. 1 is a side elevational view of a cup embodying the invention.

FIG. 2 is a central longitudinal fragmentary sectional view showing a plurality of cups embodying the invention in nested relation.

FIG. 3 is an enlarged fragmentary sectional view corresponding to the right hand portion of FIG. 2.

FIG. 4 is a sectional view corresponding to that seen in FIG. 2, and showing a plurality of alternate forms of construction.

FIG. 5 is a top plan view of the structure shown in FIG. 4.

DETAILED DESCRIPTION OF THE DISCLOSED EMBODIMENT

In accordance with the invention, reference character 10 designates a cup of molded styrofoam or similar material embodying the invention. The cup 10 includes: a bottom wall 11, and a conically shaped side wall including a first wall member 12, a second wall member 13 and a third wall member 14.

The bottom wall 11 is bounded by a lower surface 20 having an optional circular recess 21, as well as an upper surface 22 and peripheral edges 23 and 24.

The first wall portion 12 interconnects with the bottom wall 11, and is bounded by an outer conical surface 30, an inner conical surface 31, a cylindrical inner surface 32 and a horizontal ledge surface 33 bordering a cylindrical recess 34 in which the commestible 35 may be disposed.

The second wall portion 13 extends upwardly from the first wall portion 12 and is bounded by a portion of the surface 31 as well as a cylindrical outer surface 40 extending between an upper edge 42 and a medially disposed edge 43. Extending downwardly from the edge 43 to a lower edge 44 is a converging surface 45 forming a ledge.

The third wall portion 14 is disposed upwardly of the second wall portion 13, and is bounded by an upper portion of the surface 31 which extends to an edge 50. A downwardly converging surface 51 extends to an edge 52 from which an outer cylindrical surface 53 extends to a free edge 54. A horizontal surface 55 forms a lip, and extends outwardly to an edge 56 on a surface 57.

Referring to FIGS. 2 and 3 in the drawing, it will be apparent that the above described members and surfaces are so proportioned that when the cups are in nested condition, contact occurs only between the inner and outer cylindrical surfaces 32 and 53 which provide a sealing action of predetermined area and the ledges formed by the surfaces 45 and 51 which limit the ingress of a nested cup. It will be observed that the cups are otherwise free of mutual contact in such condition, so that the engaged area is at all times known and predetermined. Under normal circumstances, the same effort will be required to separate each succeeding cup.

In the preferred embodiment, the outwardly facing cylindrical surface 32 is preferably of a diameter several thousandths of an inch larger than the corresponding inwardly facing cylindrical surface 53, so that the latter will be resiliently expanded during the nesting operating to enhance the sealing effect. This expansion will cause minor surface irregularities to conform and provide an hermetic seal, without appreciably increasing the frictional forces which must be overcome when the cups are separated.

An equivalent limiting action may be obtained by abutting the lower surface 20 of one cup with the ledge surface 23, but owing to a lack of wedging action, additional sealing effect is normally not obtained.

Ordinarily, the generation of the degree of taper of the conical cup wall is determined in the following manner. If, for example, the protrusion of a cup is 0.409 inches, and if the wall thickness is 0.040 inches, then one simply constructs a rectangle which is 0.409 inches long and 0.040 inches wide. A diagonal line is then drawn through the rectangle and the resultant angle is noted. By doubling the slope of this angle, one obtains the included angle between the two opposed portions of the wall of the cup. This can also be determined mathmatically, by taking the trigonometrical tangent of the angle, using 0.040 as the side opposite the angle, and 0.409 as the adjacent side. To use this angle directly will result in rubbing of the outer surface of one cup on the inner surface of another, and I confine the contact to the cylindrical areas discussed above by increasing the angle, determined as above, by approximately one half degree. This automatically causes a space to appear between the walls of each nesting pair.

Turning now to the alternate forms of the embodiment illustrated in FIGS. 4 and 5, parts corresponding to those of the principal embodiment have been designated by similar reference characters with the additional prefix "1".

One alternate form of the embodiment differs from the principal form in the provision of a sealing membrane 60 which encloses the cylindrical recess 134. This membrane is ruptured prior to the pouring of hot water or other liquid into the cup, and is principally of value where the inner surface of the cup is accessible, as when cups are dispensed manually, rather than from a beverage machine. Where the membrane is made of an edible and soluble material, this form of the embodiment may also be used for automatic dispensing.

In another alternate form, also shown in FIG. 4, the soluble material is pre-shaped to a donut-like configuration, as indicated by reference character 136, and is supported by flanges 137 on an inner surface 138 of the cup, so as to have a maximum area thereof exposed to the solute when poured into the cup. As the members 136 are retained by the flanges 137 until dissolved, normally a protective membrane holding the soluble material in the recess of the cup is not necessary.

In keeping with the desirability of providing containers which are bio-degradable, and otherwise environmentally acceptable, the usual styrofoam construction may be conveniently substituted by forming both the cup and the wafer 60 from baked wheat or rice flour. To contribute additional mechanical strength, and waterproof the cup, a coating of albumen or suitable equivalent is applied by dipping, spraying or otherwise applying the coating to all the exposed surfaces. When dried, the albumen will suitably resist for a limited period of time the effects of both hot and cold liquids. Degradation can be improved by cracking or breaking the cup, after use, to expose the baked flour surfaces which can then disintegrate at a rate faster than that of the disintegration of the albumen coating. The wafer may be formed in a manner similar to that employed in the formation of so-called communion wafers, in which the flour mixture is merely thinly spread and allowed to dry without baking, since the wafer need not have the same mechanical strength as the cup.

I wish it to be understood that I do not consider the invention limited to the precise details of structure shown and set forth in this specification, for obvious modifications will occur to those skilled in the art to which the invention pertains.

I claim:

1. A nesting cup construction of resilient synthetic resinous material comprising: a bottom wall and a generally conically shaped side wall connected thereto, said side wall having a free upper edge, and including first, second and third wall portions; said first wall portion interconnecting with said bottom wall, and having a conical outer surface and a conical inner surface, said conical outer surface extending to said second wall portion, said conical inner wall surface extending past said second wall portion; said second wall portion being disposed above said conical outer surface, and having an outer surface extending upwardly from said first wall portion to include a first tapering portion forming a first ledge, and a first cylindrical surface extending upwardly from said ledge; said third wall portion being disposed above said second wall portion and having an inner second cylindrical surface adjacent a free upper edge thereof of unstressed diameter slightly less than that of said first cylindrical surface of said second wall portion, and a tapering surface forming a second ledge selectively engageable with said first ledge; whereby upon the nesting of a first cup within a second cup, the ingress of the former with respect to the latter is limited by engagement of said first and second ledges, and a sealing action is accomplished by the sliding engagement of said first and second cylindrical surfaces resulting in the resilient expansion of said second cup.

2. Structure in accordance with claim 1, further characterized in said cups being free of other mutual contact with the engagement of said first and second cylindrical surfaces.

3. Structure in accordance with claim 2, in which the principal inner and outer conical wall surfaces of a cup are disposed at an angle with respect to the principal axis of the cup greater than that determined by the trigonometrical tangent value computed from cup protrusion and wall thickness.

* * * * *